US010703995B2

(12) United States Patent
Waldron

(10) Patent No.: US 10,703,995 B2
(45) Date of Patent: Jul. 7, 2020

(54) SYSTEM AND METHOD FOR LIQUID HYDROCARBON DESULFURIZATION

(71) Applicant: Alternative Petroleum Technologies, Inc., Reno, NV (US)

(72) Inventor: Jack Lawrence Waldron, Reno, NV (US)

(73) Assignee: Alternative Petroleum Technologies, Inc., Reno, NV (US)

( * ) Notice: Subject to any disclaimer, the term of this patent is extended or adjusted under 35 U.S.C. 154(b) by 0 days.

(21) Appl. No.: 15/921,230

(22) Filed: Mar. 14, 2018

(65) Prior Publication Data

US 2018/0265788 A1 Sep. 20, 2018

Related U.S. Application Data

(60) Provisional application No. 62/471,159, filed on Mar. 14, 2017.

(51) Int. Cl.
*C10G 53/14* (2006.01)

(52) U.S. Cl.
CPC ..... *C10G 53/14* (2013.01); *C10G 2300/202* (2013.01)

(58) Field of Classification Search
None
See application file for complete search history.

(56) References Cited

U.S. PATENT DOCUMENTS 2,482,284 A * 9/1949 Michael ..... C07C 1/0485 518/703
2010/0300938 A1* 12/2010 Martinie ..... C10G 27/00 208/236
2011/0108464 A1* 5/2011 Rankin ..... C10G 7/00 208/220
2012/0145599 A1* 6/2012 Koseoglu ..... C10G 21/00 208/212
2012/0152804 A1* 6/2012 Koseoglu ..... C10G 21/00 208/80
2014/0299512 A1* 10/2014 Gargano ..... C10G 27/04 208/223
2015/0232765 A1 8/2015 Basfar et al.
2016/0024399 A1* 1/2016 Gargano ..... C10G 27/04 208/231

* cited by examiner

*Primary Examiner* — Tam M Nguyen
(74) *Attorney, Agent, or Firm* — The Watson IP Group, PLC; Jovan N. Jovanovic

(57) ABSTRACT

A method of desulfurizing a liquid hydrocarbon having the steps of: adding a liquid hydrocarbon to a vessel, the hydrocarbon having a sulfur content; adding a catalyst and an oxidizer to create a mixture; oxidizing at least some of the sulfur content of the liquid hydrocarbon to form oxidized sulfur in the liquid hydrocarbon; separating the liquid hydrocarbon from the mixture; and removing at least some of the oxidized sulfur from the liquid hydrocarbon. Such methods can be carried out by batch or continuously. Systems for undertaking such methods are likewise disclosed.

20 Claims, 7 Drawing Sheets

SYSTEM AND METHOD FOR LIQUID HYDROCARBON DESULFURIZATION

CROSS-REFERENCE TO RELATED APPLICATION

This application claims priority from U.S. Pat. App. Ser. No. 62/471,159 filed Mar. 14, 2017, entitled, "System and Method For Liquid Hydrocarbon Desulfurization", the entire disclosure of which is hereby incorporated by reference in its entirety.

BACKGROUND OF THE DISCLOSURE

1. Field of the Disclosure

The disclosure relates in general to liquid hydrocarbon desulfurization, and more particularly, to a system and method for the oxidation of sulfur compounds in liquid hydrocarbons.

2. Background Art

Environmental concerns continue to increase with the increased use of hydrocarbon fuels, and have increased considerably with the use of these fuels in areas of the world where environmental regulations may not be as advanced as there are in other global locations.

One pollutant of hydrocarbon fuels is Sulfur, generally in the oxide form. When present in the atmosphere, it has several deleterious effects, one of which is being a component of acid rain. Traditionally, the sulfur content (i.e., sulfur that is in its original valence state) of liquid hydrocarbons has been reduced by hydro-desulfurization, a process that requires relatively high temperatures and pressures in the presence of hydrogen gas to function economically. However, this technology is relatively costly, time consuming and expensive, which, in turn, limits the ability to rapidly assist countries in reducing Sulfur emissions.

Other methods have been developed for desulfurization. One of which is oxidative desulfurization, and another is bio oxidation. There are also drawbacks with these processes; overall they are promising. Among other drawbacks with oxidative desulfurization, it is difficult to efficiently use the reagents used during the oxidation step. The oxidizer is consumed in the reaction, and is quite costly. While in some systems, the oxidizer can be recycled, it remains difficult. Furthermore, there are operational issues associated with its implementation.

While the prior art is replete with patents directed to oxidative desulfurization, it has remained difficult to develop industrial processes for such innovations. Among other such prior art patents are U.S. Pat. No. 3,163,593 issued to Webster; U.S. Pat. No. 8,574,428 issued to Schucker; U.S. Pat. No. 7,758,745 issued to Cheng; U.S. Pat. No. 7,314,545 issued to Karas; U.S. Pat. No. 7,774,749 issued to Martinie; U.S. Pat. No. 6,596,914 issued to Gore; PCT Pub. No. WO2013/051202 published to Ellis and EP. App. Pub. No. 0482841 issued to Collins. Each of the foregoing patents is incorporated herein in its entirety.

SUMMARY OF THE DISCLOSURE

The disclosure is directed to methods and systems for the desulfurization of liquid hydrocarbons. In greater detail, the methods and systems include processes that utilize one or more vessels in which sulfur bearing liquid hydrocarbon can be mixed with a catalyst and oxidizer for a predetermined period of time. The mixture and contact induces reactions that oxidize the sulfur in the liquid hydrocarbon. The liquid hydrocarbon can be separated from the remainder of the mixture (which may include a catalyst, solid or liquid, an oxidizer (or remnants of the oxidation process, such as water), and an ionic liquid, where utilized). The liquid hydrocarbon can be then processed and filtered so as to remove the oxidized sulfur. The remainder of the mixture can be recycled and reutilized (wherein additional oxidizer may be added), until the catalyst is no longer effective, at which time it may be further processed in a catalyst recovery system.

The disclosure contemplates that the method may occur in batches that utilize a single reaction vessel, or that may utilize multiple vessels in which to have the reactions. The disclosure further contemplates that the method may occur in a continuous process utilizing a plurality of vessels in which to have reactions. For example, three vessels are shown in the continuous process, however, it is contemplated that the continuous process may comprise between five and ten vessels.

The disclosure further contemplates that the catalyst may comprise a liquid or a solid catalyst. And, a number of different catalysts are disclosed herein, as exemplary, and are not deemed to be limiting. The oxidizer is contemplated as being hydrogen peroxide, however, a number of different oxidizers are disclosed, as exemplary, and not deemed to be limiting.

In another configuration of the present disclosure, the disclosure is directed to a method of desulfurizing a liquid hydrocarbon comprising the steps of (a) adding a liquid hydrocarbon to a first vessel, the hydrocarbon having a first sulfur content; (b) adding a first catalyst and a first oxidizer to the first vessel create a first mixture; (c) oxidizing at least some of the sulfur content of the liquid hydrocarbon to form oxidized sulfur in the liquid hydrocarbon within the first vessel; (d) separating the liquid hydrocarbon and oxidized sulfur from within the first mixture; (e) directing the liquid hydrocarbon and oxidized sulfur into a second vessel, the hydrocarbon having a second sulfur content that is lower than the first sulfur content; (f) adding a second catalyst and a second oxidizer to the second vessel to create a second mixture; (g) oxidizing at least some of the sulfur content of the liquid hydrocarbon to form additional oxidized sulfur in the liquid hydrocarbon within the second vessel; (h) separating the liquid hydrocarbon and oxidized sulfur from within the second mixture; and (i) removing the liquid hydrocarbon and oxidized sulfur from within the second vessel, the liquid hydrocarbon having a third sulfur content which is lower than the second sulfur content.

In some configurations, the step of oxidizing at least some of the sulfur content within at least one of the first vessel and the second vessel further comprises at least one of the steps of: (a) agitating the first mixture within the first vessel; (b) heating the first mixture within the first vessel; (c) cooling the first mixture within the first vessel; and (d) recirculating the first mixture within the first vessel.

In some configurations, the step of agitating the first mixture further comprises the step of directing the first mixture through a shear device.

In some configurations, the method further includes the steps of: (a) removing the second catalyst and the second oxidizer from the second mixture; and (b) adding the removed second catalyst and second oxidizer into the first vessel as the first catalyst and the first oxidizer.

In some configurations, the method further comprises the step of: (a) separating the oxidized sulfur from the liquid hydrocarbon and oxidized sulfur.

In some configurations, the step of separating further comprises the step of: (a) passing the liquid hydrocarbon and oxidized sulfur through one of a solid absorbent and a liquid stripping section.

In some configurations, the step of separating further comprises the step of: (a) filtering the liquid hydrocarbon and oxidized sulfur prior to the step of passing.

In some configurations, the step of separating the liquid hydrocarbon and oxidized sulfur from within the first mixture removes more than 70% of the liquid hydrocarbon within the first mixture, and more preferably more than 90% of the liquid hydrocarbon within the first mixture.

In some configurations, the step of separating the liquid hydrocarbon and the oxidized sulfur from within the second mixture removes more than 70% of the liquid hydrocarbon within the second mixture, and more preferably more than 90% of the liquid hydrocarbon within the second mixture.

In some configurations, at least a portion of the first catalyst and the second catalyst are reused, with only a portion thereof being replaced. In some such configurations, 90% of the catalyst can be reused, with 10% being removed and replaced.

In some configurations, the method further comprises the steps of: (j) directing the liquid hydrocarbon and oxidized sulfur into a third vessel; (k) adding a third catalyst and a third oxidizer to the third vessel to create a third mixture; (l) oxidizing at least some of the sulfur content of the liquid hydrocarbon to form additional oxidized sulfur in the liquid hydrocarbon within the third vessel; and (m) separating the liquid hydrocarbon and oxidized sulfur from within the third mixture; and (n) removing the liquid hydrocarbon and oxidized sulfur from within the third vessel, the liquid hydrocarbon having a fourth sulfur content which is lower than the third sulfur content. In some configurations, the steps (j) through (n) are repeated until a final desired sulfur content is reached. In some configurations, the steps (j) through (n) are repeated at least once.

In some configurations, the method is operated continuously, so as to continuously desulfurize liquid hydrocarbon.

In some configurations, the liquid hydrocarbon and oxidizer travels sequentially from the first vessel to the second vessel, while at least a portion of the catalyst travels in an opposite direction within the system.

In some configurations, the first catalyst, the second catalyst and the third catalyst comprise a strong catalyst.

In some configurations, the strong catalyst is selected from the group consisting of: acetic acid, trifluoroacetic acid, sulfuric acid, nitric acid, hydrofluoric acid, hydrochloric acids.

In some configurations, the first oxidizer, the second oxidizer and the third oxidizer comprise hydrogen peroxide or co compounds that can produce hydrogen peroxide in aqueous environments, super oxides or organic peroxides.

In some configurations, the first catalyst, the second catalyst and the third catalyst comprise $(NH_4)_{7-x}H_xPW_{11}O_{39}$ where x=0-3.

In some configurations, the first catalyst, second catalyst or the third catalyst comprises between 0.1 and 3 moles per mole of sulfur, and more preferably between 0.5 and 1 moles per mole sulfur.

In some configurations, the first oxidizer, the second oxidizer or the third oxidizer comprises between 0.1 and 3 moles per mole of sulfur, and more preferably between 0.5 and 1 moles per mole sulfur.

In another aspect of the disclosure, the disclosure is directed to a method of continuously desulfurizing a liquid hydrocarbon comprising the steps of: (a) continuously adding a liquid hydrocarbon to a first vessel, the hydrocarbon having an initial sulfur content; (b) continuously adding a first catalyst and a first oxidizer to the first vessel create a first mixture; (c) continuously oxidizing at least some of the sulfur content of the liquid hydrocarbon to form oxidized sulfur in the liquid hydrocarbon within the first vessel; (d) continuously separating a portion the liquid hydrocarbon and oxidized sulfur from within the first mixture, the hydrocarbon having an initial lowered sulfur content that is lower than the initial sulfur content; (e) continuously directing the liquid hydrocarbon and oxidized sulfur into at least one subsequent vessel, the hydrocarbon having a subsequent sulfur content; (f) continuously adding a subsequent catalyst and a subsequent oxidizer to the second vessel to create a subsequent mixture; (g) continuously oxidizing at least some of the sulfur content of the liquid hydrocarbon to form additional oxidized sulfur in the liquid hydrocarbon within the subsequent vessel; (h) continuously separating a portion the liquid hydrocarbon and oxidized sulfur from within the subsequent mixture; and (i) continuously removing the liquid hydrocarbon and oxidized sulfur from within the subsequent vessel, the liquid hydrocarbon having a completed subsequent sulfur content which is lower than the subsequent sulfur content.

In some configurations, the steps (e) through (i) are repeated at least once.

In some configurations, the liquid hydrocarbon proceeds from the first vessel to each subsequent vessel, with the catalyst proceeding in a reverse manner starting with the final subsequent vessel.

In another aspect of the disclosure, the disclosure is directed to a system for desulfurizing a liquid hydrocarbon comprising a first vessel and a second vessel. The first vessel has an infeed in fluid communication with the first vessel, a lower exit and an upper exit. The upper exit is spaced apart from the lower exit, each spaced apart from the infeed. An agitator is associated with the first vessel. The agitator is configured to agitate the contents of the first vessel. The second vessel has an infeed in fluid communication with the first vessel, a lower exit and an upper exit. The upper exit is spaced apart from the lower exit, and each is spaced apart from the infeed. An agitator is associated with the second vessel. The agitator is configured to agitate the contents of the second vessel. The upper exit of the first vessel is in fluid communication with the infeed of the second vessel. The infeed of the first vessel is coupled to a supply of a hydrocarbon, a catalyst and an oxidizer. The infeed of the second vessel is further coupled to a supply of a catalyst and an oxidizer.

In some configurations, the system has a tank having an infeed. The infeed of the tank is in fluid communication with the upper exit of the second vessel, and, at least one outlet.

In some configurations, the system further includes a third vessel. The third vessel has an infeed in fluid communication with the second vessel, a lower exit and an upper exit. The upper exit is spaced apart from the lower exit, and each is spaced apart from the infeed. An agitator is associated with the third vessel. The agitator is configured to agitate the contents of the third vessel. The upper exit of the second vessel is in fluid communication with the infeed of the third vessel. The infeed of the third vessel is further coupled to a supply of a catalyst and an oxidizer.

In some configurations, the upper exit of the third vessel is in fluid communication with the infeed of the second vessel, and the upper exit of the second vessel is in fluid communication with the infeed of the first vessel.

In some configurations, the lower exit of the third vessel is in fluid communication with the infeed of the second vessel and the lower exit of the second vessel is in fluid communication with the infeed of the first vessel.

In some configurations, the system includes a recirculation system associated with at least one of the first and second vessels. The recirculation system is structurally configured to recirculate fluid within the respective at least one of the first and second vessels.

In yet another aspect of the disclosure, the disclosure is directed to a system for desulfurizing a liquid hydrocarbon comprising a first vessel, a second vessel a first separator and a second separator. The first vessel has an infeed in fluid communication with the first vessel, an exit spaced apart from the infeed, and, an agitator associated with the first vessel. The agitator configured to agitate the contents of the first vessel. The second vessel has an infeed in fluid communication with the first vessel, an exit spaced apart from the infeed, and, an agitator associated with the second vessel. The agitator is configured to agitate the contents of the second vessel. The first separator is associated with the exit of the first vessel. The separator is configured with at least two outlets, at least one outlet in fluid communication with the infeed of the second vessel. The second separator associated with the exit of the second vessel. The second separator configured with at least two outlets.

In some configurations, the system further comprises a third vessel and a third separator. The third vessel has an infeed in fluid communication with the second vessel, an exit spaced apart from the infeed, and, an agitator associated with the third vessel. The agitator is configured to agitate the contents of the third vessel. The third separator is associated with the exit of the third vessel. The third separator is configured with at least two outlets. At least one outlet of the second separator in fluid communication with the infeed of the third vessel. The infeed of the third vessel further coupled to a supply of a catalyst and an oxidizer.

In some configurations, the system includes a recirculation system associated with at least one of the first and second vessels, the recirculation system structurally configured to recirculate fluid within the respective at least one of the first and second vessels.

In some configurations, the system includes a tank having an infeed, the infeed of the tank in fluid communication with the upper exit of the second vessel, and, at least one outlet.

BRIEF DESCRIPTION OF THE DRAWINGS

The disclosure will now be described with reference to the drawings wherein.

DETAILED DESCRIPTION OF THE DISCLOSURE

Figure 1:
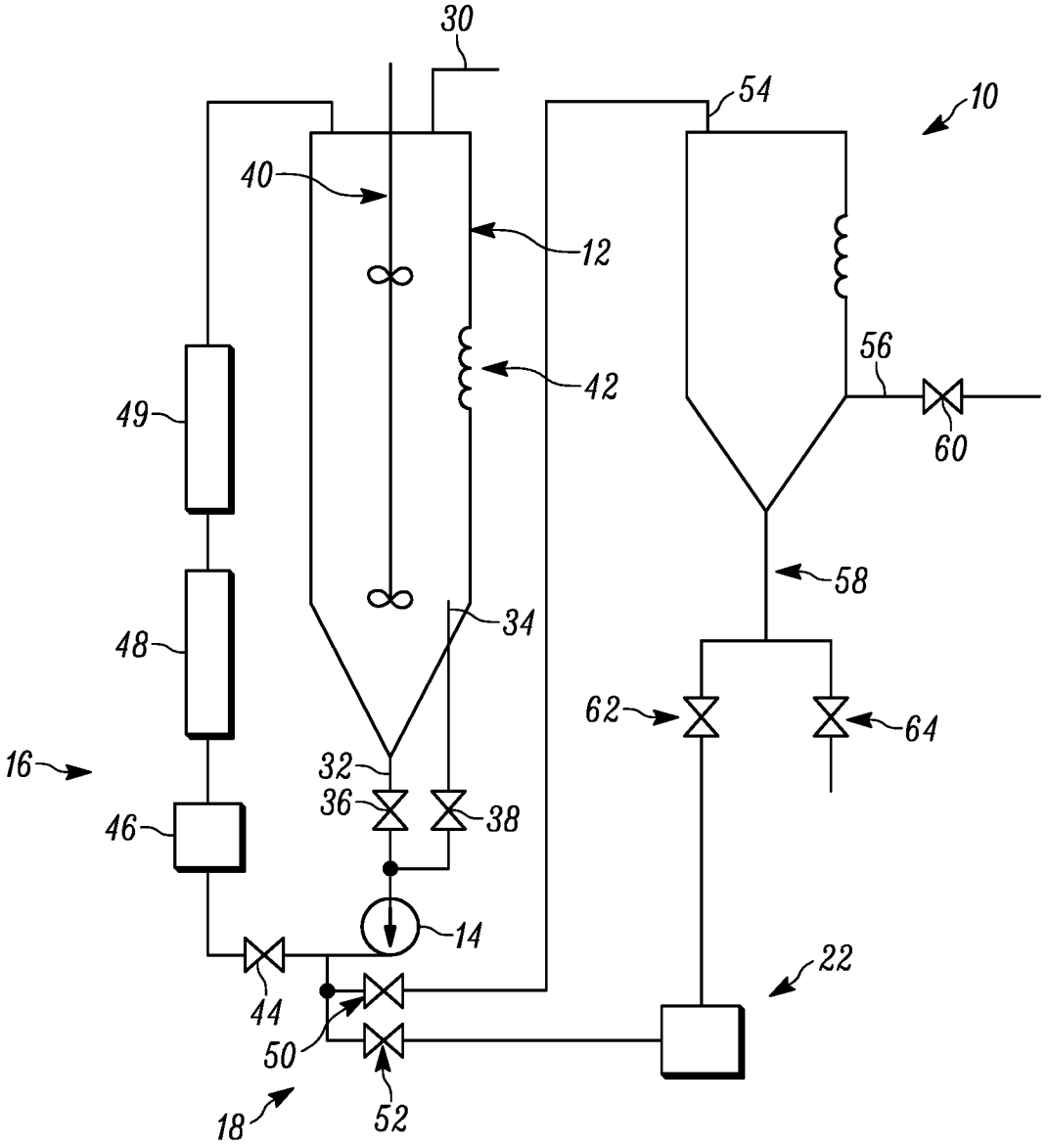
FIG. 1 of the drawings is a schematic representation of a system of the present disclosure, showing, in particular, a batch desulfurization method for a liquid hydrocarbon.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, systems and methods for liquid hydrocarbon desulfurization are shown and disclosed. Such systems have variation in the type of catalyst. That is, both liquid and solid catalysts are contemplated for use. In addition, such systems and methods may be prepared in one tank batches, or multi-tank batches, as well as in a continuous process. As such, the disclosure will be first explained with respect to a batch process, utilizing a single tank, and in configurations that utilize a liquid catalyst (typically introduced as an aqueous phase, as will be explained hereinbelow) and also configurations that utilize a solid catalyst (typically introduced as a slurry). While not being limited thereto, among other liquid hydrocarbons, it is contemplated that such hydrocarbons may include naphthalene at a lighter end to heavier fuel oils, such as #3 diesel, as well as distillates that include various grades and classes of fuel. Of course, this is not to be deemed limiting, and is for exemplary purposes only. It is contemplated that heavier and lighter liquid hydrocarbons are likewise processable with the present system and method. It will be understood that the sulfur content of the hydrocarbon is in its original valence state, and it is this sulfur that is oxidized and then removed.

With reference to FIG. 1, the single batch system is shown generally at 10. The single batch system includes a vessel 12, a pump 14, a recirculation system 16, a transfer system 18, a tank 20 and a catalyst recovery system 22. The vessel 12 includes a generally elongated vessel that is generally arranged in a substantially vertical orientation (or an orientation wherein the contents thereof can separate and can be effectively accessed separately after separation). In the configuration shown, the vessel is rather elongated and substantially vertical, with a conical lower end. The vessel includes infeed 30, lower exit 32, upper exit 34, agitator 40 and heater 42. The infeed is positioned proximate the top of the vessel, with the upper exit being spaced apart from the bottom and the lower exit being positioned at the bottom. It will be understood that the relative position of the exits is such that they can access different regions of the vessel (that is, once the contents are separated, the different exits can access different layers of the separated contents).

The agitator can be placed in the vessel and can comprise any number of different structures which can stir or mix the contents of the vessel to agitate the contents and to force interaction of the different contents, such as a mixer, an ultrasonic device, a blade mixer or the like. The heater 42 is positioned so as to provide heat to the vessel, and the contents of the vessel. Any number of different types of heaters are contemplated for use. One such heater may comprise an insertion heater or a heating jacket.

The flow of the contents from the upper exit is controlled by valve 38 whereas the flow of the contents from the lower exit is controlled by valve 36.

The pump 14 includes an inlet that can receive fluid passing through valve 36 or valve 38. The outlet can be directed to the recirculation system 16, transfer system 18 or the catalyst recovery system 22.

The recirculation system includes valve 44, shear device 46, heater 48 and cooler 49 (which may only be present where a solid catalyst is utilized). The shear device, as discussed below can improve the mixing of the contents. The heater and cooler 48, 49, assist with the reaching and maintaining of the proper temperature within the vessel 12. As will be understood, fluid passes through valve 44 and through the heater and/or cooler and then back into the vessel. It will also be understood that depending on the configuration, either one or both of the heater and cooler can be omitted, and depending on the catalyst that is utilized, there may not be a need to have either or both. Additionally, with the use of heater 48, the heater 42 may be omitted. The heater 48, it is contemplated, may comprise an immersion heater, a heat exchanger supplied with steam or water, or another heating system.

The transfer system includes valve 50 which is fluidly coupled to the tank 20 at infeed 54. The tank 20 also includes upper exit 56 and lower exit 58. The upper exit is controlled by valve 60 with the lower exit being controlled by valves 62, 64. The valve 62 controls the flow to the catalyst recovery system 22 from the tank 20.

The method of desulfurizing liquid hydrocarbon with be explained with reference to the flow chart of FIG. 2 in conjunction with the system of FIG. 1. As such, the four digit reference numbers will refer to method steps of FIG. 2, and two digit reference numbers will refer to the system shown in FIG. 1. At step 1000, liquid hydrocarbon is added to the vessel 12. The agitator 40 is also actuated at step 1010.

Although not required, it is often desirable to raise the temperature of the hydrocarbon. At step 1020, heaters may be activated to heat the vessel or the hydrocarbon. In some configurations, the heater 42 of the vessel 12 is actuated. In other configurations, the recirculation system 16 is activated. The recirculation system is configured to recirculate fluid that is removed from lower exit 32 (or upper exit 34), through the corresponding valve 36, 38 and pumped through the valve 44, then through shear device 46, heater 48 and cooler 49. This recirculation can for example recirculate any desired percentage of the fluid that is within the vessel. In the configuration shown, the recirculation rate is about $1/10^{th}$ of the reactor volume per minute. Of course, other rates are likewise contemplated and nothing herein shall be deemed limiting as to the recirculation rate.

At the step 1020, it is desirable to raise the temperature to, in the configuration shown, approximately 65° C.-70° C. although temperatures between approximately 45° C. and approximately 80° C. are contemplated. It is desired that the temperature be at a level that balances reaction time with minimizing oxidizer degradation. Of course, it is preferred to maintain the temperature below the flash point of the liquid hydrocarbon. It is also preferred that the liquid hydrocarbon is not boiled or coked due to the application of heat.

Once the desired temperature is reached, the heaters and the recirculation system can be utilized to maintain the desired temperature.

Next, at step 1030, the catalyst can be added to the vessel 12 through the infeed 30. In some configurations, a liquid catalyst is utilized. The liquid catalyst is added as an aqueous phase mixture that is defined as including a liquid acid catalyst (which can be either a strong or weak acid, or a combination of both), an oxidizer and an ionic liquid. In some configurations, the ionic liquid can be eliminated. Examples of liquid acid catalysts contemplated for use with the present disclosure include, but are not limited to, acetic acid, Trifluoroacetic acid, Sulfuric acid, Nitric acid, Hydrofluoric acid, Hydrochloric acids among others. As will be understood, a strong acid by definition is an acid that is completely disassociated or ionized in an aqueous solution. It has been found that halogen acids (hydrochloric and hydrofluoric, for example), appear to be less efficient. It is thought, although not confirmed, that the lower efficiency may be due to possible side reactions of the halogen compounds. It is contemplated that the pH of the strong acids is generally less than 2, and preferably less than 1.

Examples of oxidizers that can be utilized include, but are not limited to, hydrogen peroxide, as well as, other compounds can be used in the place of hydrogen peroxide, including, but not limited to co compounds that can produce hydrogen peroxide in aqueous environments, such as super oxides, or oxidants, such as organic peroxides, which ultimately have substantially the same end reactions. Also, other compounds that can support the electron transfer are contemplated. Examples of ionic liquid that can be utilized include, but are not limited to, 1-ethyl-3-methylimidazolium ethyl sulfate. It will be understood that the total amount of the aqueous phase, and the relative ratios of the constituents in the aqueous phase can be varied depending on the amount of sulfur in the liquid hydrocarbon and the speciation of the same. It is contemplated that the dosing of the reagents may be, preferably, 0.1 to 3 moles oxidizer per mole sulfur, 0.1 to 3 moles acid catalyst (as a single acid or blends of other acids) per mole sulfur, and, preferably 0.1 to 3 moles ionic liquid per mole of sulfur. More preferably, it is desirable that the reagent dosage be 0.5 to 1 mole oxidizer per mole of sulfur and 0.5 to 1 moles acid catalyst per mole sulfur. It is contemplated that the ionic liquid may be zero, and it is further contemplated that the oxidizer and/or acid catalyst may be below 0.1 and above 3, these are less preferred, as the ranges identified as preferred strike a preferred balance between acceptability and cost.

In other configurations of the method, a solid catalyst along with oxidizer can be used in place of the liquid catalyst. With a solid catalyst, in place of a liquid catalyst, the solid catalyst is added as a slurry, being slurried with either the liquid hydrocarbon to be treated or the oxidizer. Examples of solid catalysts contemplated for use include, but are not limited to, $(NH_4)_{7-x}H_xPW_{11}O_{39}$ where x=0-3. Examples of the oxidizer utilized include those identified above with the liquid catalyst in the aqueous phase. It will be understood that if the solid catalyst is slurried with the oxidizer, the reaction will start upon introduction into the liquid hydrocarbon. On the other hand, if slurried with the hydrocarbon, the combination is agitated for a period of time (such as, for example, between 5 and 15 minutes) to disperse the solid catalyst, prior to the introduction of the oxidizer. Similar reaction times can be seen with the solid catalyst as can be seen with the liquid catalyst.

As the catalyst, solid or liquid (and other materials, such as the oxidizer and the remainder of the aqueous phase), is added to the vessel, the agitator 40 as well as the recirculation system (and the shear device 46 therein) are running. It is contemplated that the shear device may comprise a number of structures and devices, such as static mixers, inline rotor/stator shear devices, ultrasonic mixers, as well as devices that are disclosed in, for example, U.S. Pat. No. 8,192,073 issued to Waldron et al. It is desirable to provide a sufficiently small droplet size of the liquid catalyst and to distribute the same within the liquid hydrocarbon. Additionally, with the use of a solid catalyst, the recirculation system, and the shear devices serve to disperse the solid catalyst and also to create sufficiently small droplet sizes for the oxidizer.

At step 1040, the oxidation of the sulfur is monitored. The reaction time can vary in a range from approximately 15 minutes and 5 hours, although greater or lesser amounts of reaction time are also contemplated. The oxidative power of the components can be monitored to allow the operator to know when the oxidation is complete. Once it is determined that the reaction has reached a desired level of completion, at step 1050, the agitator is stopped. Also, the recirculation can be stopped at step 1060 along with the heater(s).

Once the recirculation is stopped and the heaters are stopped, at step 1070, the contents of the vessel are allowed to separate. It will be understood that the aqueous phase, or the solid catalyst (which here is present along with any remaining oxidizer and any water) settles at the bottom of the vessel, with the liquid hydrocarbon settling thereabove. In some configurations, the separation can occur in the vessel 12. In other configurations, it is contemplated that, after the reaction has completed, the mixture can be transferred to the tank 20 through the lower exit 32, the pump 14, and valve 50 of the transfer system 18. The separation of the catalyst (again, solid or liquid) and the hydrocarbon can then occur in the tank 20.

In the solid catalyst configuration, at step 1070, the separation of the liquid hydrocarbon and the solid catalyst is done in either the vessel or in the tank. In some configurations, the separation is initiated by the cooling of the combination hydrocarbon and solid catalyst to approximately 25° C. or less (but typically greater than 0° C.). Such cooling can be achieved by coolers or chillers, for example. In other configurations, the separation is allowed to occur at the reaction temperatures.

Once the catalyst (with constituents) and the liquid hydrocarbon have separated, which generally occurs in about between 2 and 5 minutes (although both longer and shorter separation times are contemplated), the hydrocarbon can be removed at step 1080. Where the separation occurred in the vessel, to achieve the same, the valve 38 is opened to allow the liquid hydrocarbon to exit through the upper exit 34 and to be pumped by pump 14 through the valve 50 and into the infeed 54 of tank 20. It is contemplated that substantially all of the liquid hydrocarbon has been removed and separated. It will be understood that some liquid hydrocarbon can fail to separate fully and may remain in the vessel, however, at least 70% and preferably over 90% and even more preferably 99% of the liquid hydrocarbon is removed.

The tank 20 is, in the configuration shown, utilized as a holding tank. The liquid hydrocarbon can be removed from tank 20 through the upper exit 56 and valve 60. The liquid hydrocarbon can be filtered and the oxidized sulfur can be stripped out by numerous methods. Among other methods, the oxidized sulfur can be removed by passing the liquid hydrocarbon through a solid absorbent or a liquid stripping section. Among other solid absorbents, it is contemplated that alumina, silica gel, certain clays, zeolites, and ion exchange resins can be utilized. As for the liquid stripping section, the same works by contacting the liquid hydrocarbon with a stripping liquid which then removes the oxidized sulfur. Such liquids include, but are not limited to, Acetonitrile, Methanol and liquid ion exchange fluids.

Once the oxidized sulfur is removed, at step 1120, the desulfurized hydrocarbon can be stored for shipment, further refining and/or for use.

At step 1090, the aqueous solution is removed from the vessel 12. This is accomplished by opening valve 36 and allowing the fluid out from the lower exit, then allowing the fluid to be pumped through the valve 52 and into the catalyst recovery system 22. It is also contemplated that the aqueous solution can remain in the vessel 12 so that for a subsequent desulfurization, once the liquid hydrocarbon is added, further aqueous solution may not be required, or only the oxidizer need be resupplied. It is contemplated that the catalyst can be recycled a number of times at step 1110. Only once it is spent, is the remaining catalyst directed to the catalyst recovery system.

In the configuration wherein the entire mixture is directed from the vessel into the tank 20, the separation of the liquid hydrocarbon and the catalyst (in the case of a solid catalyst, the catalyst/oxidizer/water slurry and in the case of the liquid catalyst, the remaining aqueous phase) happens within the tank 20. In such a configuration, once the contents have settled, the liquid hydrocarbon can be removed through the upper exit 56 controlled by valve 60 and can be filtered and the oxidized sulfur can be stripped out.

The catalyst can be removed through valve 64 and can be placed in storage wherein further oxidizer can be added, and the catalyst can be reused. On the other hand if the catalyst has been spent, the remaining catalyst can be removed through lower exit 58 of tank 20 and can be directed through valve 62 to the catalyst recovery system 22.

Regardless of how it is separated, or in which tank the separation occurs, in an effort to maximize the use and recycling of the catalyst, one can remove a given portion of the catalyst and replace the same amount with a new catalyst, without replacing the entire amount. For example, if the catalyst is configured to last 10 cycles, the operator can remove 10% of the remaining catalyst after a single cycle, and add 10% fresh aqueous solution to the mix for the next batch. In such a configuration, it is contemplated that the efficiency of the catalyst does not drop significantly, and the recycle rate of 10 batches per catalyst can be achieved.

Figure 3:
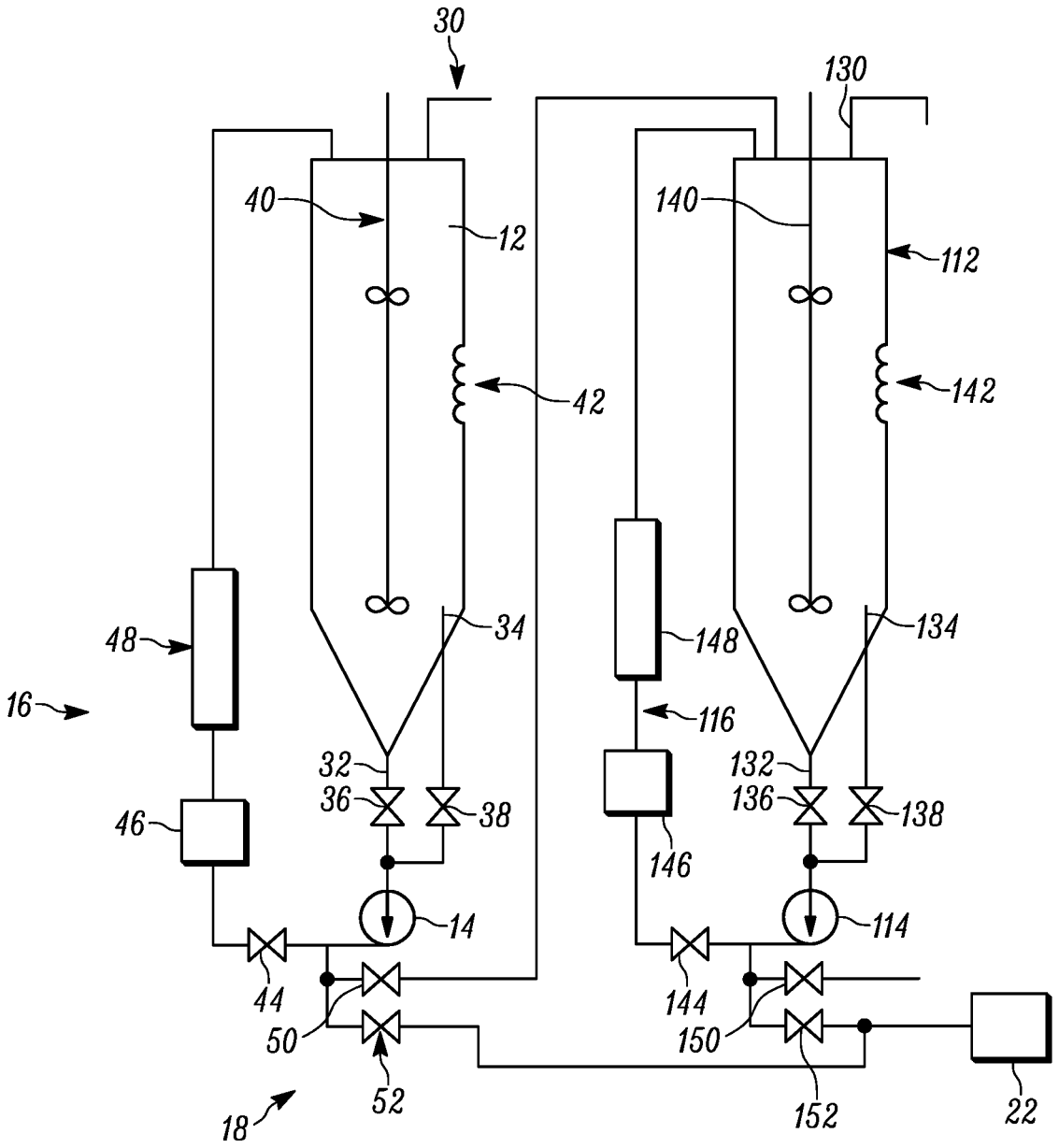
FIG. 3 of the drawings is a schematic representation of a system of the present disclosure, showing, in particular, a multi-vessel batch desulfurization method for a liquid hydrocarbon.
Figure 4:
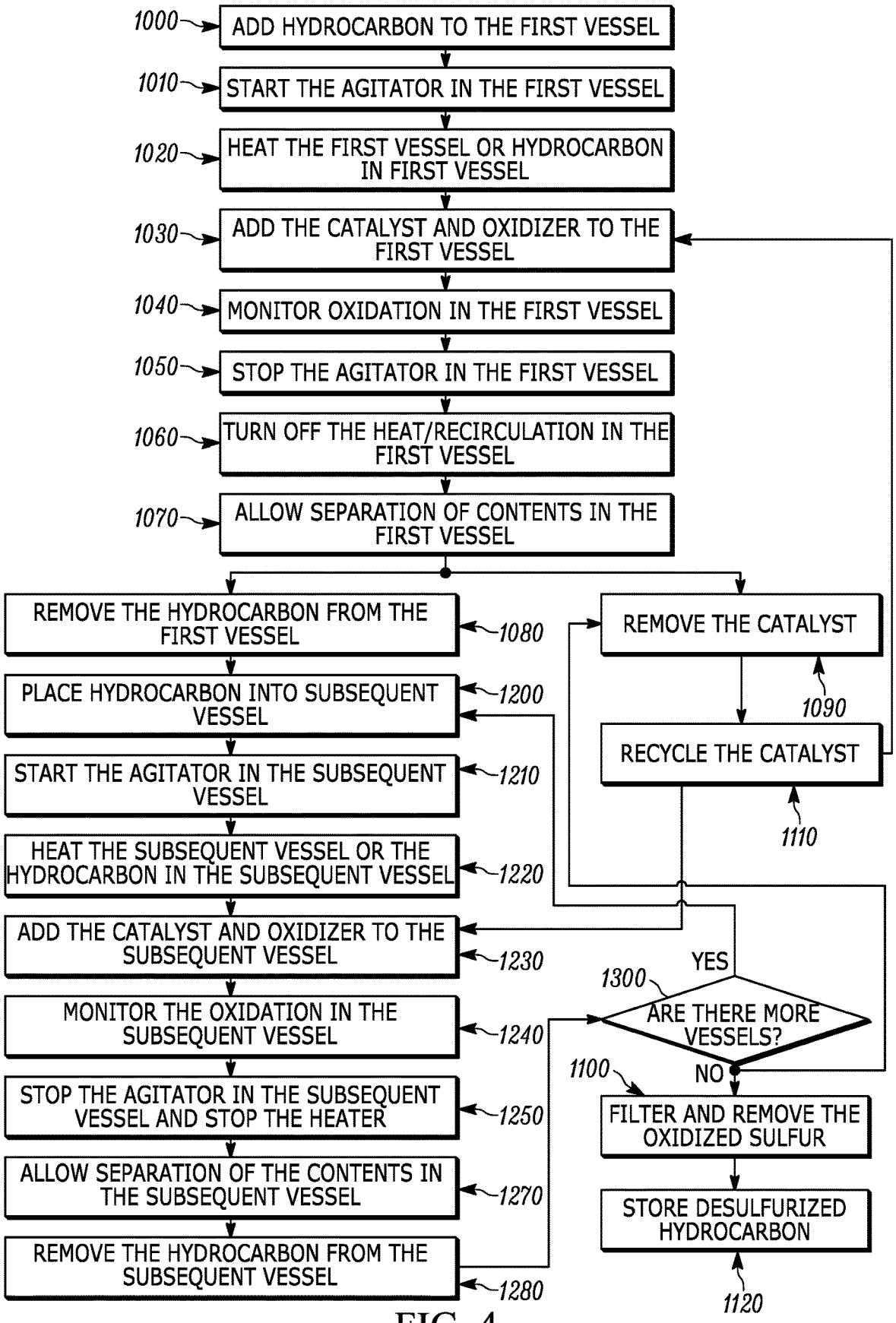
FIG. 4 of the drawings is a flow chart of a method of operation of a multi-vessel batch desulfurization of a liquid hydrocarbon.

With reference to FIGS. 3 and 4, a system and method of batch producing in multiple vessels is disclosed. It will be understood that in the configuration shown in FIG. 3, a pair of side by side systems, each having a vessel, a pump, a recirculation system, are shown. It will be understood that additional systems, beyond the two shown, and of the type shown in FIG. 1 can be added in series. As such, similar reference numbers have been utilized to describe the components that are shared with the batch system shown in FIG. 1, with the second one augmented by 100. As such, the batch system can include several vessels. Also, it will be understood that a tank may be present after the final one of the vessels.

Figure 2:
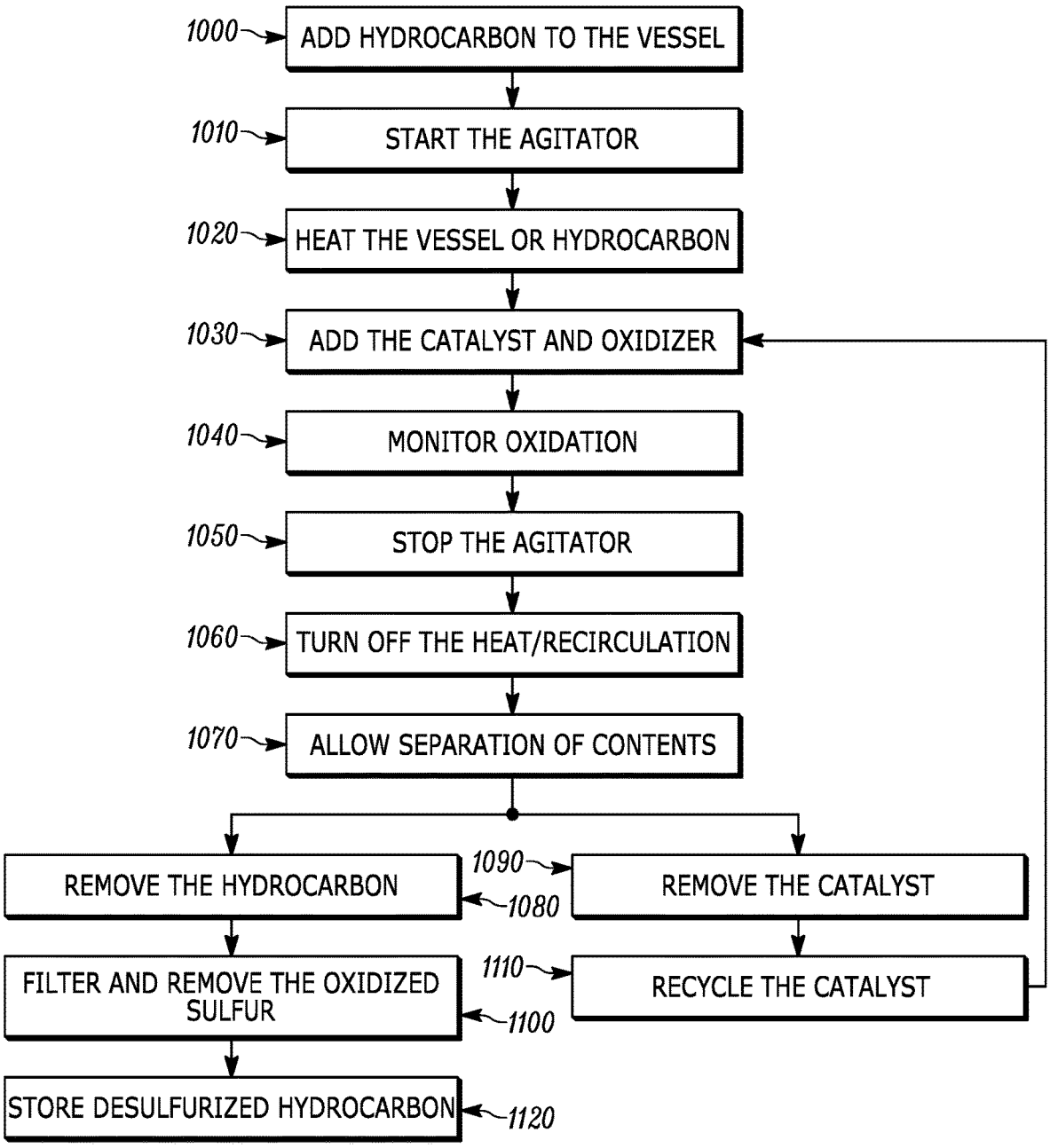
FIG. 2 of the drawings is a flow chart of a method of operation of batch desulfurization of a liquid hydrocarbon.

With respect to the method, and with reference to FIG. 4, the initial steps 1000 through 1090 are substantially identical to the method above with respect to FIG. 2. At step 1080, however, when the liquid hydrocarbon is removed, it is instead directed into a subsequent vessel. The initial steps are then repeated as with the first vessel, at steps 1200 through 1270. The steps 1200 through 1270 are substantially similar to the steps 1000 through 1070, and as such, the reference numbers are augmented by 200 to show the similarity.

Once step 1270 is reached, and the liquid hydrocarbon has been removed from the subsequent vessel, the determination is made at step 1300 as to whether there is an additional vessel in this multiple vessel system. In the embodiment shown, there are only two vessels, and, as such, there is no subsequent vessel. In that case, the answer at 1300 is "no" and the hydrocarbon can be filtered and the oxidized sulfur can be removed in various methods at step 1100, many of which methods are described above, such, as, for example, with the tank 20 and the and the system associated with the transfer system 18. The desulfurized liquid hydrocarbon can then be stored for shipment, use or further processing.

At the same time, the catalyst is removed and recycled back into either the first or second vessel, or if spent, the catalyst can be sent to the catalyst recovery system.

In the event that there were more than the two vessels, at step 1300, if the answer is "yes", the hydrocarbon is placed into the subsequent vessel, and the processing steps of 1200 through 1270 are repeated. Once completed, again, the question is asked at 1300 as to whether there is an additional vessel. If the answer is "yes", the steps 1200 through 1270 are repeated in the subsequent vessel. If the answer is "no" then the method proceeds to steps 1090 and 1100 with the liquid hydrocarbon and the catalyst.

Advantageously, the required amount of catalyst (again, either liquid or solid, with the appropriate other constituents utilized for each, as described above) can be split between the different vessels. As such, each can be tailored to different ratios and they can be varied and different between the vessels. This can maximize the efficiency of the catalyst, including, the rate of the reaction, the degree of oxidation and the reagent consumption. That is, each vessel can have different catalysts, different amounts of catalyst, different amounts and ratios of constituents (i.e., catalyst, oxidizer, ionic liquid) within the catalyst combination and mixture to have a differently controlled reaction in each vessel.

Figure 5:
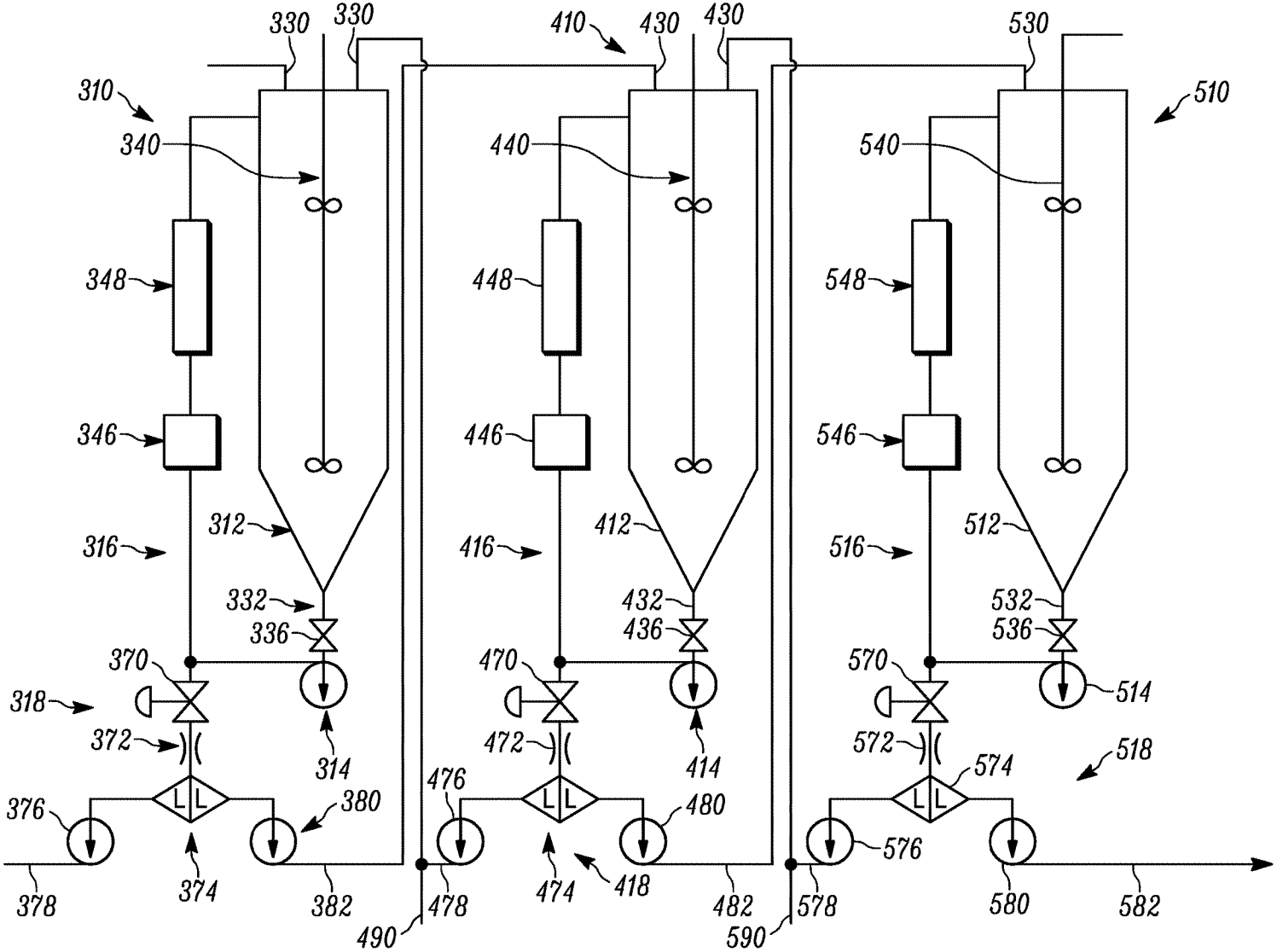
FIG. 5 of the drawings is a schematic representation of a system of the present disclosure, showing, in particular, a continuous desulfurization method for a liquid hydrocarbon, utilizing a liquid catalyst.
Figure 6:
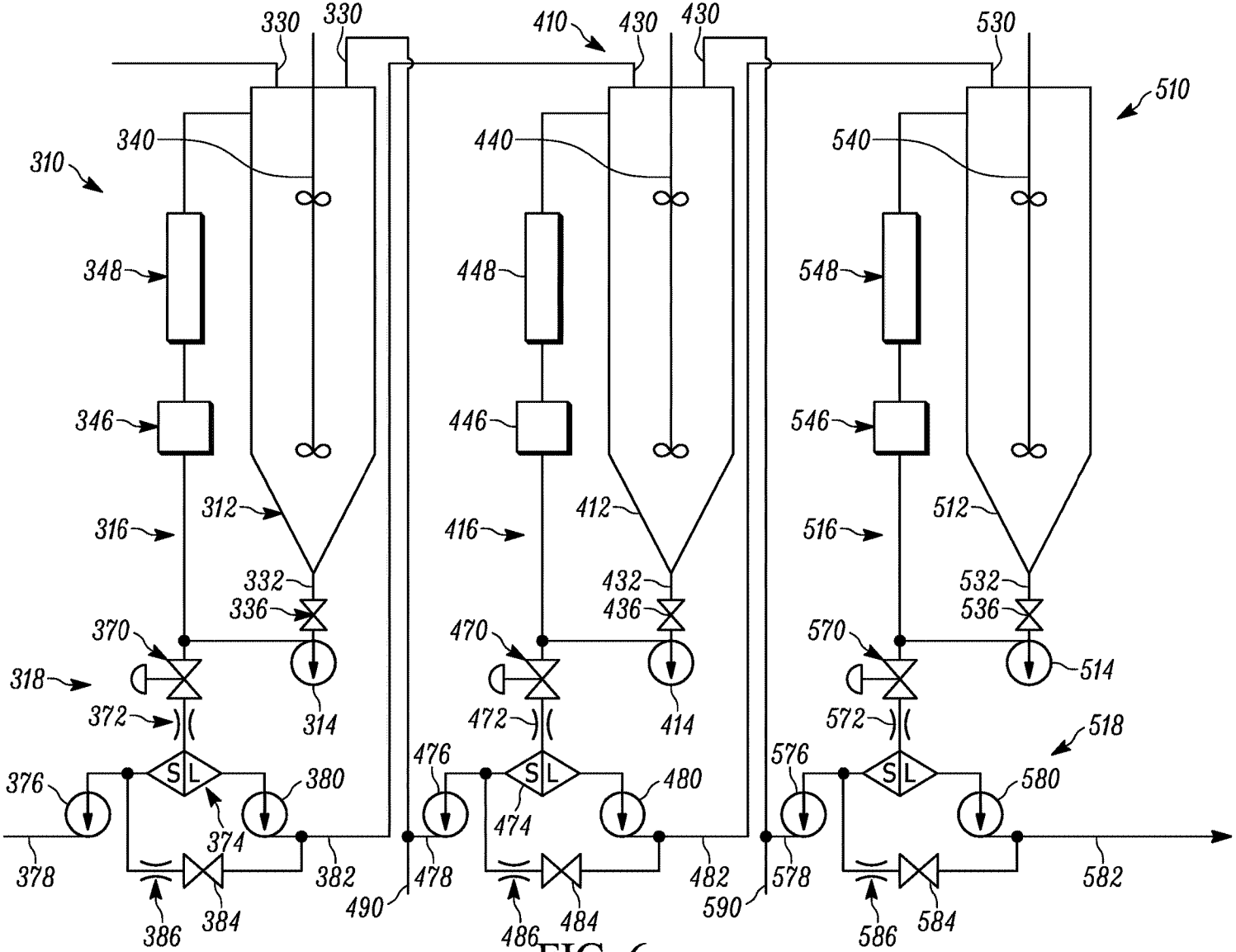
FIG. 6 of the drawings is a schematic representation of a system of the present disclosure, showing, in particular, a continuous desulfurization method for a liquid hydrocarbon, utilizing a solid catalyst.
Figure 7:
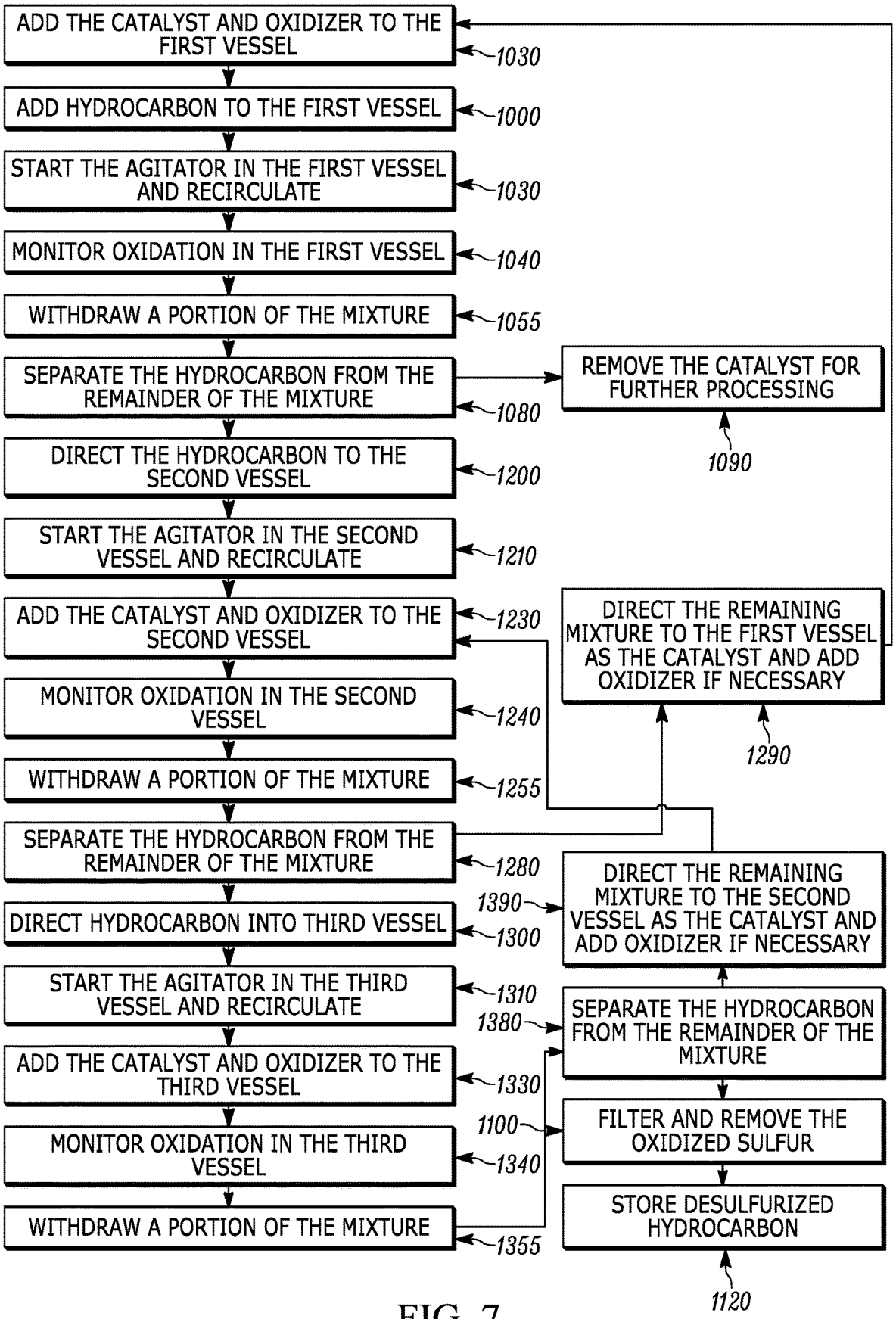
FIG. 7 of the drawings is a flow chart of a method of operation of a continuous desulfurization of a liquid hydrocarbon.

With reference to FIGS. 5, 6 and 7, a continuous system and method is shown. Essentially, the system comprises a plurality of processing units, each of which is substantially similar. In the configuration shown, a total of three processing units, 310, 410, 510 are shown. It is contemplated that more than three processing units are contemplated, or that only two processing units can be utilized (or even a single processing unit). While three are shown, it is contemplated that the continuous process may have between 5 and 10 processing units (although a greater or fewer number are also contemplated). In the continuous system, the similar components are disclosed and identified with the same reference numbers augmented by 300 for the first processing unit, 400 for the second processing unit and 500 for the third processing unit. The processing units interact with the processing unit immediately before or after the processing unit in question.

The first processing unit 301 includes a vessel 312, pump 314, recirculation system 316 and transfer system 318. The vessel 312 includes infeed 330, and lower exit 332 controlled by valve 336. The pump 314 is coupled at the one end to the valve 336 and at the other end to the recirculation system.

The transfer system 318 depends from the pump and separates from the recirculation system 316. The transfer system 318 includes valve 370 which can divert flow from the recirculation system 316, flow meter 372, separator 374, catalyst pump 376 and hydrocarbon pump 382.

The flow is diverted from the valve 370 in an amount controlled by flow meter 372 to direct a predetermined quantity of hydrocarbon and catalyst system to separator 374, which separates the liquid hydrocarbon from the remainder of the mixture. The hydrocarbon is pumped through hydrocarbon pump 380 to output 382 which is directed to the infeed of the subsequent system, namely infeed 430. At the same time, the remaining constituents of the mixture (the catalyst, remaining oxidizer, any water and ionic liquid) are pumped via catalyst pump 376 to the output 378, which is generally directed to the infeed of the prior processing unit (or in the case of the first processing unit, set for recycling of or further processing by a catalyst recovery assembly (not shown). The separator may comprise any number of different structures, such as a centrifuge, a conventional liquid/solid or liquid/liquid (depending on the catalyst utilized) separator such as a cyclone, sedimentation, among others. The disclosure is not limited to any particular type of separator.

With reference to FIG. 6, a system is shown for solid catalyst. In such a configuration, the amount of liquid in the constituent mixture that is separated at the separator 374 may require additional fluid to insure proper flow through the catalyst pump. In that condition, valve 384 and flow meter 386 may direct flow from the hydrocarbon output 382, in a desired amount to the input of the catalyst pump 380 to insure the proper flow. The amount of hydrocarbon that is diverted will vary depending on the configuration and the constituent mixture. This hydrocarbon can be recaptured through later processing in other processing units, or can be set aside for later processing with the catalyst recovery system. For example, tanks may be present after the final vessel so as to contain the liquid hydrocarbon and the oxidized sulfur for treatment and separation.

Referring again to both FIGS. 5 and 6, each subsequent unit is coupled to the previous unit as the output 382 and 482 are directed to the subsequent infeed 430, 530, respectively, and the output 478, 578 of the catalyst pump 476, 576 is directed into the infeed 330, 430 of the preceding unit. That is, as the liquid hydrocarbon progresses to subsequent units, the catalyst constituent mixture progresses to prior units. It will further be understood that additional oxidizer may need to be directed into the infeed of subsequent vessels, and the same can be supplied at oxidizer supplies 490 and 590.

The method of the operation is shown in FIG. 7, once in the steady state production operation, with liquid hydrocarbon and catalyst mixtures contained in each of the vessels, and with a level of desulfurization occurring in each vessel. In this continuous method, one of the conceptual advantages is that the liquid hydrocarbon proceeds to subsequent vessels, while the catalyst mixture proceeds to previous vessels. In that manner, the catalyst that has the highest degradation (or least activity) is directed into the first vessel which has the highest un-oxidized sulfur content, thereby maximizing the potential for the catalyst.

Preferably, in the continuous system, the liquid hydrocarbon is initially heated to the desired temperature (similar to the above-identified temperatures). At such time, the hydrocarbons are added to the first vessel 1000 at a desired flow rate. The catalyst is already present in the first vessel at step 1030. The agitator and the recirculation is on so as to agitate and recirculate the mixture while oxidizing. If additional oxidizer is needed, it may be supplied through the infeed.

As the reaction continues, at step 1055, a portion of the mixture is removed (and the removal is matched to the supply of liquid hydrocarbon and the catalyst mixture to maintain relatively constant volume within the vessel) through the transfer system 318. The removed mixture is separated through a separator and separated into the liquid hydrogen on the one hand and the catalyst mixture on the other hand. The liquid hydrogen is directed in step 1200 into the second vessel, where the same steps as in the first vessel are occurring. The catalyst mixture is removed for further processing at step 1090. It will be understood that, as set forth above, in the case of a solid catalyst, it may be necessary to divert a portion of the separated liquid hydrocarbon to the catalyst mixture to insure that the same can be pumped by the catalyst pump. Additional hydrocarbons are continuously added to the first vessel.

The liquid hydrocarbon that has been separated in the transfer system 318 is then processed through the second vessel, wherein additional catalyst mixture (and oxidizer) can be added at step 1230. It will be understood that in the steady state operation, the catalyst mixture is supplied by the separated catalyst mixture from the third vessel at step 1390.

As the process continues in the second vessel, the transfer system 418 removes a portion of the mixture that is being recirculated by step 1210. The removed mixture at step 1255 is then separated at step 1280 into the liquid hydrocarbon and the catalyst mixture. The liquid hydrocarbon is directed in step 1300 to the third vessel, whereas the remaining catalyst mixture (and added oxidizer to the extent necessary) can be added to the first vessel at step 1030.

The liquid hydrocarbon is processed in the third vessel along with a catalyst and oxidizer that is supplied thereto, at, for example, step 1330. As, in the configuration shown, the third vessel comprises the last unit, it is contemplated that the freshest or newest catalyst mixture is provided to this vessel. At 1310, the agitator can be started and recirculation can be started, although, this step may be accomplished after the step 1330 or with step 1330.

The oxidation occurs at the step 1340 and during the process, at step 1355, a portion of the mixture is removed. At step 1380 that portion is separated into liquid hydrocarbon and a catalyst mixture. The catalyst mixture at step 1390 is directed into the second vessel to supply the catalyst (with additional oxidizer being supplied) to the step 1230.

The liquid hydrocarbon is then filtered and the oxidized sulfur can be removed at step 1100. At step 1120, the desulfurized hydrocarbon can be stored for use, shipment or further processing.

Advantageously, the volume in the vessels remains substantially constant. That is, as the mixture is removed by each of the transfer systems, the same amount of hydrocarbons and catalyst mixture that is removed from each vessel is then supplied to each vessel. As described above, the liquid hydrocarbon proceeds from the first vessel to the third vessel, with the sulfur oxidation increasing in the liquid hydrocarbon through each vessel. At the same time, the catalyst mixture proceeds from the third vessel to the first vessel and in each subsequent vessel that capacity of the catalyst is diminished. As such, the catalyst that is removed from the first vessel is sent to recycling and reprocessing, while the hydrocarbon from the third vessel is ready for filtration and removal of oxidized sulfur.

This continuous system can work with either the liquid or the solid catalyst system described above. As set forth above, it may be necessary to alter the separator and to provide liquid hydrocarbon to the catalyst pump to achieve proper flow and movement of the solid catalyst (that will then be in a slurry). Such a system can operate continuously, adding new catalyst mixtures to the third vessel (and oxidizer to, potentially all three vessels) and continuously adding high sulfur content liquid hydrocarbon to the first vessel. It will be understood that new catalyst mixtures may need to be added to the other vessels, depending on the configuration. It will further be understood that substantially more than three vessels may be added, in which case, there is a first vessel and a last vessel that parallel the first and third vessels, and middle vessels that parallel the second vessel in the configuration shown.

With respect to monitoring the reaction, a number of different structures and methods are contemplated. For example, the oxidizer may comprise hydrogen peroxide. In that case, in an oxidation, the case can be described as a combination of two half-cell reactions, one oxidizing and one reducing, namely:

$$H_2O_2+2(H+)+2(e-)=2(H_2O)\ E=1.776\text{Volts}$$

$$H_2O_2=O_2+2(H+)+2(e-)\ E=-0.682\ \text{Volts}$$

As long as there is sufficient material to be oxidized (i.e., sulfur and other compounds) the first reaction is predominant. However, as the reaction continues and more and more compounds are oxidized and exist in the oxidized state, the second reaction increases in importance. In addition, due to the relatively strong oxidizing power of the peroxide, other items (including present water itself) becomes oxidized and exists outside of the normal stability zones, which renders these strong reducing agents.

At some point of the reaction, an equilibrium is attained wherein the rate of reduction gets close to the rate of oxidation, and the reaction rate slows and potentially reverses. This can be seen by both the shift of the measured oxidation potential and a rapid increase in the production of oxygen.

One manner of addressing this issue, although not preferred, is to add further hydrogen peroxide, catalyst or both. A small benefit can be gained for a relatively short period of time, upon which time the reaction reaches equilibrium. As such, this manner of addressing the issue tends not to be the most helpful.

Another manner of addressing the system and the issue is through pH control. However, such a control is difficult to implement, as there is little water by mass of the overall volume of the mixture. It is possible to offset the pH initially, however this can be detrimental to the stability of the catalysts during oxidation.

To address the issue, it has been determined that positive results can be reached when the liquid hydrocarbon is separated from the oxidizer (and the catalyst) before, after or as equilibrium is reached. The liquid hydrocarbon can then be contacted (i.e., mixed) with a fresh mixture of catalyst and hydrogen peroxide for the oxidation to then continue.

It is contemplated that other compounds can be used in the place of hydrogen peroxide, including, but not limited to co compounds that can produce hydrogen peroxide in aqueous environments, such as super oxides, or oxidants, such as organic peroxides, which ultimately have substantially the same end reactions. As such, the monitoring of the oxidation in each of the methods can be achieved by monitoring the period of time for the reaction to achieve equilibrium based upon the monitoring of the sulfur oxidation. For example, a standard ORP probe can be utilized, and the change in the reading of the ORP (as opposed to the actual ORP reading value) that can be monitored. This same monitoring can be utilized for each of the vessels in which the oxidation of sulfur occurs.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A method of desulfurizing a liquid hydrocarbon comprising the steps of:

(a) adding a liquid hydrocarbon to a first vessel, the hydrocarbon having a first sulfur content;

(b) adding a first catalyst and a first oxidizer to the first vessel create a first mixture;

(c) oxidizing at least some of the sulfur content of the liquid hydrocarbon to form oxidized sulfur in the liquid hydrocarbon within the first vessel;

(d) separating the liquid hydrocarbon and oxidized sulfur from within the first mixture;

(e) directing the liquid hydrocarbon and oxidized sulfur into a second vessel, the hydrocarbon having a second sulfur content that is lower than the first sulfur content;

(f) adding a second catalyst and a second oxidizer to the second vessel to create a second mixture;

(g) oxidizing at least some of the sulfur content of the liquid hydrocarbon to form additional oxidized sulfur in the liquid hydrocarbon within the second vessel;

(h) separating the liquid hydrocarbon and oxidized sulfur from within the second mixture; and (i) removing the liquid hydrocarbon and oxidized sulfur from within the second vessel, the liquid hydrocarbon having a third sulfur content which is lower than the second sulfur content, wherein the liquid hydrocarbon and oxidized sulfur travels sequentially from the first vessel to the second vessel, while at least a portion of the catalyst travels in an opposite direction.

2. The method of claim 1 wherein the step of oxidizing at least some of the sulfur content within at least one of the first vessel and the second vessel further comprises at least one of the steps of:

(a) agitating the first mixture within the first vessel;

(b) heating the first mixture within the first vessel;

(c) cooling the first mixture within the first vessel; and (d) recirculating the first mixture within the first vessel.

3. The method of claim 2 wherein the step of agitating the first mixture further comprises the step of directing the first mixture through a shear device.

4. The method of claim 1 further comprising the step of:

(a) separating the oxidized sulfur from the liquid hydrocarbon and oxidized sulfur after the step of removing the liquid hydrocarbon and oxidized sulfur from within the second vessel.

5. The method of claim 4 wherein the step of separating further comprises the step of:

(a) passing the liquid hydrocarbon and oxidized sulfur through one of a solid absorbent and a liquid stripping section.

6. The method of claim 5 wherein the step of separating further comprises the step of:

(a) filtering the liquid hydrocarbon and oxidized sulfur prior to the step of passing.

7. The method of claim 1 wherein the step of separating the liquid hydrocarbon and oxidized sulfur from within the first mixture removes more than 70% of the liquid hydrocarbon within the first mixture, and the step of separating the liquid hydrocarbon and the oxidized sulfur from within the second mixture removes more than 70% of the liquid hydrocarbon within the second mixture.

8. The method of claim 1 wherein at least a portion of the first catalyst and the second catalyst are reused, with only a portion thereof being replaced.

9. The method of claim 1 further comprising the steps of:

(j) directing the liquid hydrocarbon and oxidized sulfur into a third vessel;

(k) adding a third catalyst and a third oxidizer to the third vessel to create a third mixture;

(l) oxidizing at least some of the sulfur content of the liquid hydrocarbon to form additional oxidized sulfur in the liquid hydrocarbon within the third vessel; and (m) separating the liquid hydrocarbon and oxidized sulfur from within the third mixture; and (n) removing the liquid hydrocarbon and oxidized sulfur from within the third vessel, the liquid hydrocarbon having a fourth sulfur content which is lower than the third sulfur content.

10. The method of claim 9 wherein the steps (j) through (n) are repeated until a final desired sulfur content is reached.

11. The method of claim 10 wherein the steps (j) through (n) are repeated at least once.

12. The method of claim 1 wherein the method is operated continuously, so as to continuously desulfurize liquid hydrocarbon.

13. The method of claim 9 wherein the liquid hydrocarbon travels sequentially from the second vessel to the third vessel, while at least a portion of the catalyst travels in an opposite direction.

14. The method of claim 9 wherein the first catalyst, the second catalyst or the third catalyst comprise a strong catalyst.

15. The method of claim 14 wherein the strong catalyst is selected from the group consisting of: acetic acid, trifluoroacetic acid, sulfuric acid, nitric acid, hydrofluoric acid, hydrochloric acids.

16. The method of claim 9 wherein the first oxidizer, the second oxidizer or the third oxidizer comprise hydrogen peroxide or co compounds that can produce hydrogen peroxide in aqueous environments, super oxides or organic peroxides.

17. The method of claim 9 wherein the first catalyst, the second catalyst or the third catalyst comprise (NH4)7-x HxPW11O39 where x=0-3.

18. The method of claim 9 wherein the first catalyst, second catalyst or the third catalyst comprises between 0.1 and 3 moles per mole of sulfur, and more preferably between 0.5 and 1 moles per mole sulfur.

19. The method of claim 9 wherein the first oxidizer, the second oxidizer or the third oxidizer comprises between 0.1 and 3 moles per mole of sulfur, and more preferably between 0.5 and 1 moles per mole sulfur.

20. A method of continuously desulfurizing a liquid hydrocarbon comprising the steps of:

(a) continuously adding a liquid hydrocarbon to a first vessel, the hydrocarbon having an initial sulfur content;

(b) continuously adding a first catalyst and a first oxidizer to the first vessel create a first mixture;

(c) continuously oxidizing at least some of the sulfur content of the liquid hydrocarbon to form oxidized sulfur in the liquid hydrocarbon within the first vessel;

(d) continuously separating a portion the liquid hydrocarbon and oxidized sulfur from within the first mixture, the hydrocarbon having an initial lowered sulfur content that is lower than the initial sulfur content;

(e) continuously directing the liquid hydrocarbon and oxidized sulfur into at least one subsequent vessel, the hydrocarbon having a subsequent sulfur content;

(f) continuously adding a subsequent catalyst and a subsequent oxidizer to the at least one subsequent vessel to create a subsequent mixture;

(g) continuously oxidizing at least some of the sulfur content of the liquid hydrocarbon to form additional oxidized sulfur in the liquid hydrocarbon within the at least one subsequent vessel;

(h) continuously separating a portion the liquid hydrocarbon and oxidized sulfur from within the subsequent mixture; and (i) continuously removing the liquid hydrocarbon and oxidized sulfur from within the at least one subsequent vessel, the liquid hydrocarbon having a completed subsequent sulfur content which is lower than the subsequent sulfur content, wherein the liquid hydrocarbon and oxidized sulfur travels sequentially from the first vessel to the at least one subsequent vessel, while at least a portion of the catalyst travels in an opposite direction.

* * * * *